United States Patent [19]

Breslau

[11] Patent Number: 4,846,217

[45] Date of Patent: Jul. 11, 1989

[54] INJECTION VALVE

[75] Inventor: David Breslau, Arlington, Mass.

[73] Assignee: Massachusetts Institute of Technology, Cambridge, Mass.

[21] Appl. No.: 834,220

[22] Filed: Feb. 27, 1986

[51] Int. Cl.[4] ..... F02M 39/00; B05B 1/32

[52] U.S. Cl. ..... 137/543.17; 137/537; 123/472; 239/453; 239/533.7

[58] Field of Search ..... 123/499, 472, 446; 137/543.17, 537; 251/337; 239/453, 95, 533.1–533.15

[56] References Cited

U.S. PATENT DOCUMENTS

| | | | |
|---|---|---|---|
| 1,862,368 | 6/1932 | Cuthbertson . | |
| 1,886,205 | 11/1932 | Lyford et al. . | |
| 2,119,966 | 6/1938 | Scott | 299/107.3 |
| 2,249,971 | 7/1941 | Mecorney | 137/537 |
| 2,555,803 | 6/1951 | Mashinter et al. | 299/133 |
| 2,756,106 | 7/1956 | Schenk | 137/537 |
| 2,756,107 | 7/1956 | Korda | 239/453 |
| 2,832,691 | 4/1958 | Korda | 137/537 |
| 2,875,779 | 3/1959 | Campbell | 137/543.17 |
| 3,008,653 | 11/1961 | Morris et al. | 239/453 |
| 3,069,099 | 12/1962 | Graham | 239/453 |
| 3,105,640 | 10/1963 | Allen | 239/453 |
| 3,129,891 | 4/1964 | Vdouiak | 239/453 |
| 3,267,959 | 8/1966 | Savage | 137/516.11 |
| 3,542,293 | 11/1970 | Bishop et al. | 239/95 |
| 3,893,624 | 7/1975 | Thompson | 239/107 |
| 4,164,920 | 8/1929 | Brinkman | 123/499 |
| 4,281,797 | 8/1981 | Kimata et al. | 239/533.12 |

FOREIGN PATENT DOCUMENTS

| | | | |
|---|---|---|---|
| 897024 | 4/1972 | Canada | 137/547 |
| 3237881 | 4/1984 | Fed. Rep. of Germany . | |
| 660909 | 7/1929 | France | 137/537 |
| 921787 | 5/1947 | France . | |
| 469182 | 7/1937 | United Kingdom | 239/95 |

OTHER PUBLICATIONS

Stanadyne, *Poppet Nozzle* brochure.

United Technologies, *Diesel Fuel Injection Systems* brochure (Jun. 1983).

Stanadyne, *Model 14 Service Manual.*

*Primary Examiner*—Carl Stuart Miller

*Attorney, Agent, or Firm*—Thomas J. Engellenner

[57] ABSTRACT

A pressure sensitive valve suitable for various fluid delivery applications is disclosed consisting of a hollow body having an inlet and valve seat which defines the outlet. A valve stem is disposed within the hollow body, the stem having a valve head adapted to cooperate with the valve seat to open and close the valve, and also having a twisted biasing element which responds to fluid pressure on the valve head by linear expansion. The valve is particularly suited for automotive and industrial fuel injection.

19 Claims, 2 Drawing Sheets

INJECTION VALVE

BACKGROUND OF THE INVENTION

The technical field of this invention is fluid delivery valves and, in particular, injection valves and nozzles for fuel delivery and the like.

Injection nozzles for fuel delivery, and fluid injection generally, make use of valves which include a large number of parts or electronic control mechanisms that can have a tendency to fail during use. In a conventional or poppet-type injection nozzles, the valve head typically is biased against the valve seat by a spiral wound spring and a number of support elements to retain the spring and poppet head. These complex mechanisms are not only a frequent causes of fatigue failure but they also present structures which are difficult to clean , likely to leak or likely to catch dirt and other contaminants, thereby resulting in nozzle clogging or flow obstruction.

Moreover, spiral wound spring structures are ill-suited for precision control or metering of high rate fluid transfers. This type of spring is typically better suited for long stroke, low force, movements, while many injection applications, such as automotive gasoline or diesel fuel injections, require a short motion, higher force mechanism which can be repeatedly cycled. For example, the opening of a fuel injection valve will typically only involve a valve head displacement of only 20 to 30 thousands of an inch, every 3 hundredth of a second (at 4000 revolutions per minute).

The poppet-type injector responses to a pulse of high pressure fuel or fluid to operate a poppet, and the relatively high weight of the oscillating mass reduces the speed and the frequency with which the injector can open and close, thereby reducing the fuel economy and power output of the engine.

To avoid the problems inherent in valves which are biased by spiral wound springs, various other devices have been tried. For example, many automotive engine designs now rely upon pintle-type valves. Although these valves are more precise and can operate at a higher frequency, they are far more complex and add significantly to the cost of the fuel injection system. Moreover, the possibility of failure is compounded. In this design, a pintle is typically withdrawn to uncover an orifice by electromechanical (solenoid) means. The distance which the pintle moves is predetermined and, consequently, if any part of the nozzle assembly (pintle, orifice, activator, or control device etc.) is affected by wear, dirt, vibration, heat, electronic failure or maladjustment, the nozzle will deliver an incorrect fuel pulse, with a resulting loss of power, fuel economy or both. These factors dictate vigilant maintenance and even with such maintenance can lead to substantial repair or replcement costs.

There exists a need for better injection valves particularly for automotive applications. A simple, robust injection valve for fuel delivery in automotive engines and the like, which could be cycled with minimal risk of failure or maladjustment, would satisfy a long-felt need in the art.

SUMMARY OF THE INVENTION

A simple, highly effective, injection valve is disclosed in which the valve stem is formed by a valve head and a twisted (tension shaped) member which connects the valve head to the valve body. The twisted member responds to fluid pressure upon the valve head by linear extension, thereby opening (or closing) the valve.

In one aspect of the invention the valve is formed by a hollow body having an inlet and an outlet, the outlet defining a valve seat. The valve stem is disposed within the hollow body and preferably includes a valve head which cooperates with the valve seat to close the valve and a flat helically twisted element which biases the head against the valve seat. The valve provides a very simple fuel injection system as there are no electronic or complex mechanical components exposed to heat, vibration or dirt in the combustion chamber of the engine. The valve is also particularly well-suited for high-force, short-motion cyclical operation.

When an axially twisted biasing element is used as the tension-shaped member, the valve can also be designed to self-cleaning. In such a valve, fluid pressure on the valve head causes the twisted biasing element to rotate as it undergoes linear expansion. As a result there is a wiping action of the valve head against the valve seat each time the helical biasing element is extended (untwisted) and retracted (retwisted). Moreover, because the only sliding fit in the mechanism is the seat, there are fewer failure points.

The valve can be operated, for example, by a remote-mounted fluid pump which delivers the fluid via tubing to the valve inlet. The pressure of the fluid pulse is selected to overcome tension of the biasing member, which normally secures the valve head against the valve seat. By proper design of the valve head and seat, the fluid flow rate through the valve can also be made proportional (or inversely proportional) to the fluid flow. Thus, for example, the valve can be designed to open at 1000 p.s.i. and to reach the maximum flow rate at 1500 p.s.i.

In automotive and industrial engine operations, the pump is preferably a solenoid-type fuel pump which delivers timed pulses of fuel in synchronization with the engine cycle. The solenoid stroke can be varied to allow more or less fuel to be injected in response to engine requirements.

The valve is particularly robust in automotive applications because the working parts can be recessed from the combustion chamber and therefore can be maintained in cooler temperature environment. Moreover, the twisted biasing element is only exposed when fuel is flowing through the valve and thereby is kept cool by a fuel fluid bath.

Additionally, the valve head and valve seat can be formed by mating bevelled surfaces; seating is accomplished with much less need for precision in the forming operations (unlike in the design of needle valves where a cylindrical rod must slide freely in a slightly larger cylindrical passageway). Additionally, the placement or location of the fluid inlet on the valve body is not critical. For these reasons, the valves of the present invention are largely insensitive to alignment problems.

Once the valve head shape and the bias tension have been set in manufacture, the valve essentially can operate as a slave. The valve will exhibit no variability in operation except for a proportional response to fluid pressure. Hence, all of the control systems can be situated upstream in a less hostile environment.

The invention will next be described in connection with certain illustrated embodiments. However, it should be clear to those skilled in the art that various changes and modifications can be made without departing from the spirit or scope of the invention. For example, although the following detailed description is primarily directed to fuel injection applications, other uses for the present invention can include fuel burning furnaces and boilers, paint spraying, irrigation, shock absorbers, atomizers, polymer and dye mixing and various other applications where the distribution of a spray or fine mist is needed. Additionally, pressure-sensitive valves according to the invention can be biased in either a normally closed or normal opened position or can be designed to permit fluid injection only when the pressure exerted by the fluid on the head lies within a defined pressure range.

Valves according to the present invention can be made from various materials including steel, brass, titanium and delrin. In automotive fuel injection applications the materials would be selected to give appropriate performance and life in a fuel combustion area. As used herein, the term "twisted" or "tension shaped" is intended to include not only flat, helically twisted members but also other twisted shapes (e.g. serpentine or accordion-like structures) which can likewise readily undergo linear extension in response to fluid pressure.

DETAILED DESCRIPTION

Figure 1A:
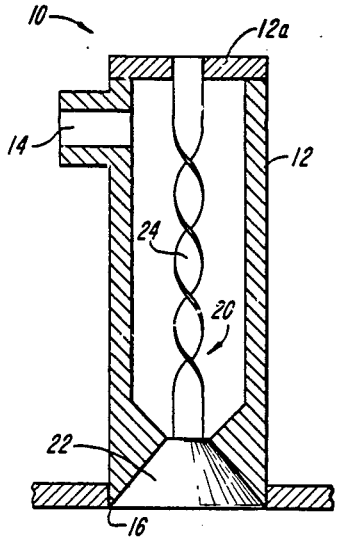
FIG. 1A and FIG. 1B are schematic illustrations of an injection valve according to the invention.
Figure 1B:
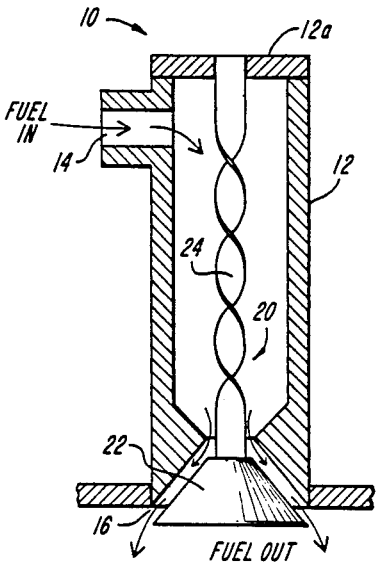

In FIG. 1A and FIG. 1B a fuel injection valve 10 according to the invention is illustrated consisting of a valve body 12 and end cap 12*a*, the valve body having an inlet 14 and an outlet defined by a valve seat 16, and a valve stem member 20 disposed within the hollow body. The valve stem 20 further included a valve head 22 which cooperates with the valve seat 16 to close the valve, and a twisted biasing member 24 which responds to fluid pressure upon the valve head 22 within the hollow body 12 by undergoing linear expansion to open the valve as shown in FIG. 1B.

In one embodiment, the valve stem 20 is cold formed (forged) from stainless steel alloy 302 (SAE 30 302) to a shape that includes a short conical head portion and a flatten tail portion. This material is used for tensile strength and heat resistance. It has very high corrosion resistance, allowing it to be used with a wide variety of fuels, and in both gasoline and diesel combustion environments. It is hardened to a controlled degree by the cold forming operation. The initial shaping of the stem can be accomplished, for example, by automated processing of 302 alloy rods with side mounted dies. The tail portion (which forms the biasing member) is then flattened by flattening dies and trimmed to a proper width and length. The flatten tail portion is preferably trimmed to a length about 50% longer than the finished length to facilitate twisting into final shape.

The partially-formed valve stem can then be fed into a finishing machine where the tail is held while the valve head is ground to a final shape. After the head is shaped, the finishing machine twists the tail portion, for example, into a axially twisted helical shape.

The valve body can be formed in two pieces: a cylindrical body part and an end cap. The cylindrical body part can be cold forged from stainless steel alloy 304 (SAE 30 304). This material is similar to the 302 alloy but has somewhat greater ductility. It is also cold formed for shape and hardness.

Preferably, the cylindrical body part is formed from 304 tubing in a machine that rough forms the valve seat by a combination of side and front die movement. Then a grinding head finishes the valve seat. As shown in FIGS. 1A and 1B the valve seat is preferably formed as a cylindrical bevelled surface which is mated with the conical valve head having the same angular shape and dimensions.

A side hole is drilled in the cylindrical body part to form the inlet 14. In one mode of assembly the cylindrical body part is cut to length and a shallow counterbore is turned in the back (at the opposite end from the bezelled seat). The counterbore is fitted with an end cap, which can be stamped out of 304 sheet material as a disk-shaped element with a rectangular slot. The slot is of slightly larger dimensions than, and designed to receive, the flat edge of the twisted biasing member 24.

The nozzle can then be assembled by inserting the valve stem 20 into the valve body 12, such that the valve head 20 and seat 16 mate. The end cap is slid over the flat section of the valve spring, and mates with the counterbore in the valve body. The flat end of the valve spring is grasped and tensioned by a collet, while the end cap and bottom section of the valve body is held by a partially closed die. When the proper degree of tension is reached, the die closes, permanently bonding the valve body, valve stem, and the end cap. The remaining valve spring is cut off.

For purposes of further illustration, Table 1 below presents exemplary dimensions for an injection valve according to the present invention.

TABLE 1

| Valve Dimensions | | |
|---|---|---|
| Valve Body | | |
| length | .88 | inches |
| outer diameter | .375 | inches |
| inner diameter | .20 | inches |
| major diameter of seat | .28 | inches |
| counterbore I.D. | .300 | inches |
| counterbore depth | .06 | inches |
| included angle of seat | 50.0 | degrees |
| Valve Stem | | |
| length | .88 | inches |
| major diameter of head | .28 | inches |
| bias element width | .16 | inches |
| bias element thickness | .04 | inches |
| bias element twist | 2.5 | turns |
| head bevel angle | 50.0 | degrees |
| End Cap | | |
| diameter | .298 | inches |
| thickness | .06 | inches |
| slot width | .165 | inches |
| slot height | .045 | inches |

Figure 2:
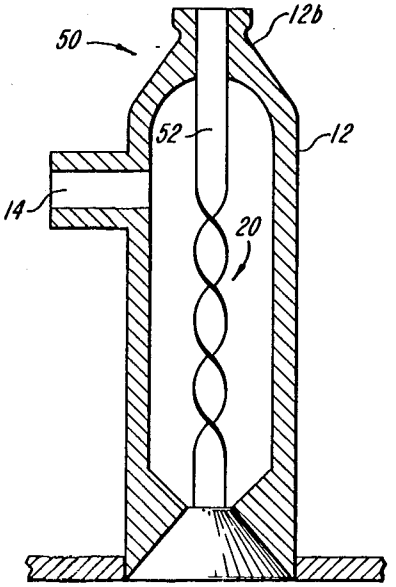
FIG. 2 illustrates an alternative construction of an injection valve according to the invention.

It should be clear that various other manufacturing techniques can be employed to construct the valves of the present invention. For example, as shown in FIG. 2, the end cap can be eliminated as a separate part of the valve and the valve body can be constructed as a single element. In this embodiment the valve stem 20 can be formed from a cylindrical rod of steel alloy and the cylindrical shape can be retained at the tail portion. The valve stem is then secured within the body under tension and the body and stem can be bonded together by a crimp 12b or similar structure.

In automotive application the inlet and outlet can also be fitted with appropriate coupling elements to connect them with the fuel pump and combustion chamber, respectively. Moreover, the spray pattern of the valves disclosed herein can be varied by changing the shape of the valve head and/or seat.

Figure 3:
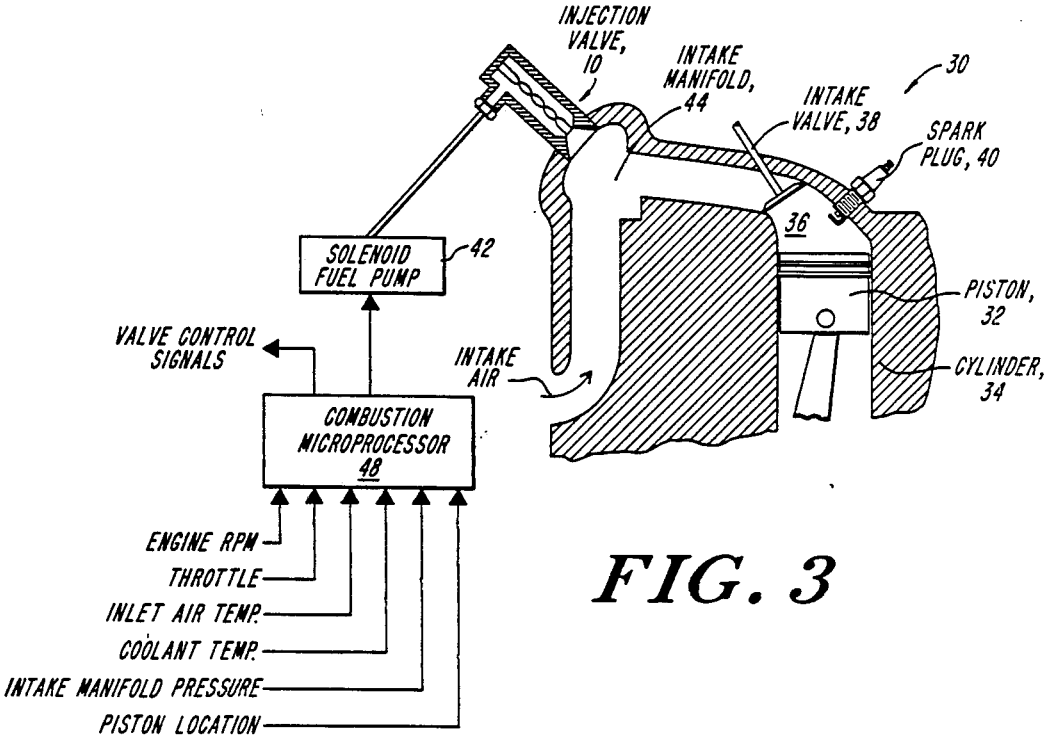
FIG. 3 is a schematic illustration of an automotive engine employing the valve of FIG. 1.

In FIG. 3 an internal combustion engine 30 incorporating the present invention is shown. The engine 30 includes at least one piston 32 disposed within a cylinder 34 for reciprocating motion therein in response to combustion of a fuel in chamber 36. Upon the injection of fuel via injection valve 10 and the opening of intake valve 36, an air-fuel mixture is introduced into chamber 36 and ignited by spark plug 40 to provide the force for the piston's reciprocating motion. One or more additional piston-cylinder combinations (not shown) are typically situated (with substantially identical valves and ignition controls) within the engine 30 to provide cyclical motion.

In the automotive illustration FIG. 3, the injection valve is controlled by a combustion microprocessor 48 which responds to various sensors (e.g., engine RPM's, throttle setting, inlet air temperature, coolant temperature, intake manifold pressure, and piston location). The microprocessor 48 provides valve control signals and activates a fuel pump 42 which provides fluid pulses under pressure to the injection valve 10. When the pressure exceeds the tension setting of the valve 10, the valve opens and admits the fuel into the intake manifold 44 where it mixes with intake air. The spark plug 40 can also be controlled by the combustion microprocessor 48 or it can be activated in a conventional manner by a cam shaft-driven spark distributor.

Figure 4:
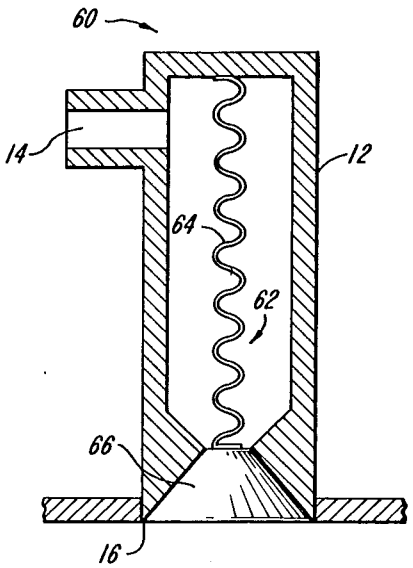
FIG. 4 illustrates an alternative valve stem configuration according to the invention.
Figure 5:
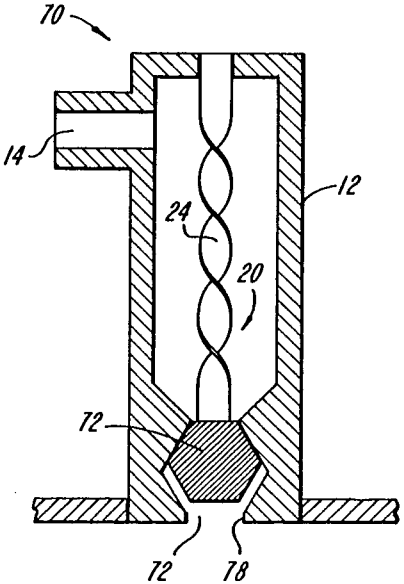
FIG. 5 illustrates an alternative valve head design according to the invention.

FIGS. 4 and 5 illustrate alternative embodiments of the present invention. In FIG. 4 an injection valve 60 is shown having a valve stem 62 formed by a serpentine twisted member 64 and a valve head 66. The valve head 66 cooperated with the valve seat 16 to open and close the valve in a manner identical to the valve of FIGS. 1A and 1B. The other elements of FIG. 4 (having the same reference members as corresponding elements in FIGS. 1A and 1B) function as described in connection with the earlier figures.

In FIG. 5 a valve 70 is shown wherein the valve seat outlet 76 is modified so that valve head 72 cannot be ejected from the valve body 12 if the biasing element 24 breaks or otherwise becomes detached. To prevent ejection the seat 76 includes a collar 78 which is narrower that the major diameter of the valve stem 72.

FIG. 5 also illustrates how a "normally-open" valve embodying the present invention can be constructed. If the valve 70 is assembled as described above without tension, any low fluid pressure on the valve head will be sufficient to allow fluid passage through outlet 76. However, with increasing pressure, the bias element 24 will unwind as described above thereby causing linear expansion of the valve stem assembly 20. When the pressure exceeds a predetermined level, the valve head 72 will be stopped against a mating surface on collar 78 thereby shutting the flow off. In this manner the valve can serve as a check valve or pressure regulator.

What is claimed is:

1. A valve comprising:

a hollow valve body having an inlet and an outlet, the outlet defining a valve seat; and a valve stem member disposed along an axis within the hollow body and having a valve head adapted to cooperate with the valve seat to open and close the valve, the valve stem further characterized by a biasing member of substantially solid cross-section which is twisted about said axis, said cross-section having its centroid lying along said axis, and which responds to fluid pressure upon the valve head within the hollow body by untwisting about said axis to provide linear extension.

2. The valve of claim 1 wherein the biasing element is a helically twisted torsion element.

3. The valve of claim 1 wherein the valve is normally closed and the valve head and valve seat cooperate to open the valve when the fluid pressure within the valve body exceed a predetermined level.

4. The valve of claim 3 wherein the valve head and valve seat further cooperate such that fluid transfer through the valve is proportional to the fluid pressure upon the valve head.

5. The valve of claim 1 wherein the valve is normally open, and the valve head and valve seat cooperate to close the valve when the fluid pressure exceeds a predetermined level.

6. The valve of claim 5 wherein the valve head and valve seat further cooperate such that fluid transfer through the valve is inversely proportional to the pressure.

7. The valve of claim 1 wherein the valve head and valve seat are formed by mating bevelled surfaces.

8. The valve of claim 1 wherein the valve seat includes a collar narrower than the major diameter of the valve head.

9. A method of delivering a fluid, the method comprising:

introducing a fluid under pressure into a valve body, the body having an inlet and an outlet, which outlet defines a valve seat; and disposing a valve stem along an axis within the valve body, the valve stem having a valve head adapted to cooperate with the valve seat, the valve stem being formed from a biasing member of substantially solid cross-section which is twisted about said axis, said cross-section having its centroid lying along said axis, and which responds to higher fluid pressure by untwisting about said axis to provide linear extension; and adjusting the fluid pressure in relation to the tension of the valve stem to define an opened valve condition and a closed valve condition.

10. The method of claim 9 wherein the twisted member is held in tension against the valve seat to close the valve in the absence of fluid pressure and responds to fluid pressure by opening the valve.

11. The method of claim 9 wherein the valve is normally open and the twisted member responds to fluid pressure by linear expansion until it engages the valve seat to close the valve.

12. In an internal combustion engine having a cylinder with a piston reciprocatively operative therein, a combustion chamber, an inlet valve for admitting a fuel-air mixture from a manifold to the combination chamber, and an ignition device, the improvement comprising an injection valve for injecting fuel into the mainfold to form a fuel-air mixture, the injection valve comprising:

a hollow body having an inlet and on outlet, the outlet defining a valve seat; and a valve stem disposed about an axis within the hollow body, the stem having a valve head, adapted to cooperate with the valve seat to normally close the valve, and an axially-twisted biasing member of substantially solid cross-section, said cross-section having its centroid lying along said axis, which responds to fluid pressure by untwisting about said axis to provide linear extension and thereby open the valve.

13. The engine of claim 12 wherein the valve is controlled by a microprocessor in response to engine conditions.

14. The engine of claim 12 wherein fuel is delivered to the valve inlet by a fuel pump.

15. A method of manufacturing a valve, the method comprising:

forming a hollow valve body, having an inlet and an outlet, the outlet defining a valve seat;

forming a valve stem about an axis within the hollow body having a valve head adapted to cooperate with the valve seat to open and close the valve and a biasing member having a substantially solid cross-section twisted about said axis, said cross section having its centroid lying along said axis, and capable of responding to fluid pressure upon the valve head by untwisting about said axis to provide linear extension; and disposing the valve stem within the valve body.

16. The method of claim 15 wherein the twisted member is formed as a flat helically twisted element.

17. The method of claim 15 wherein the valve stem is secured within the valve body under tension to hold the valve head against the valve seat in absence of fluid pressure within the valve body.

18. The method of claim 15 wherein the components are cold forged by die presses.

19. The method of claim 15 wherein the valve head and valve seat are formed as mating bevelled surfaces.

* * * * *